US007601044B2

(12) United States Patent
Suzuki

(10) Patent No.: US 7,601,044 B2
(45) Date of Patent: Oct. 13, 2009

(54) METHOD OF MANUFACTURING PLURAL PLASMA DISPLAY PANELS INCORPORATING THROUGH PORTS AT PERIPHERAL CORNERS OF EACH MANUFACTURED DISPLAY

(75) Inventor: Masanori Suzuki, Osaka (JP)

(73) Assignee: Panasonic Corporation, Osaka (JP)

( * ) Notice: Subject to any disclaimer, the term of this patent is extended or adjusted under 35 U.S.C. 154(b) by 322 days.

(21) Appl. No.: 10/592,706

(22) PCT Filed: May 12, 2006

(86) PCT No.: PCT/JP2006/309580

§ 371 (c)(1),
(2), (4) Date: Sep. 13, 2006

(87) PCT Pub. No.: WO2006/123587

PCT Pub. Date: Nov. 23, 2006

(65) Prior Publication Data

US 2008/0132137 A1 Jun. 5, 2008

(30) Foreign Application Priority Data

May 16, 2005 (JP) ..... 2005-142664
May 16, 2005 (JP) ..... 2005-142665

(51) Int. Cl.
*H01J 9/00* (2006.01)

(52) U.S. Cl. ..... 445/25; 445/24

(58) Field of Classification Search ..... 445/24, 445/25

See application file for complete search history.

(56) References Cited

U.S. PATENT DOCUMENTS 6,236,446 B1 5/2001 Izumi et al.

FOREIGN PATENT DOCUMENTS

| | | | |
|---|---|---|---|
| JP | 2000-268726 A | | 9/2000 |
| JP | 2001-283741 A | | 10/2001 |
| JP | 2003132793 A | * | 5/2003 |
| JP | 2007141655 A | * | 6/2007 |
| KR | 1999-0030087 | | 9/2000 |

OTHER PUBLICATIONS

Korean Office Action issued in Korean Patent Application No. 10-2008-7030435, mailed Mar. 6, 2009.

* cited by examiner

*Primary Examiner*—Mariceli Santiago
(74) *Attorney, Agent, or Firm*—McDermott Will & Emery LLP

(57) ABSTRACT

A method of manufacturing a plasma display panel in which a discharge space is formed by a pair of glass substrates disposed to face each other, and a through port is formed at a corner portion of at least one of the glass substrates for evacuating the discharge space and filling a discharge gas. The method includes: a step of forming the through port of the glass substrate to a rim portion of a substrate glass that is to be cut into two or more of the glass substrate; and a step of forming a structure of the plasma display panel to the substrate glass. With such a method, the substrate glass can be prevented from being cracked or damaged so that the multi-plane manufacturing technique can be realized with high yield.

2 Claims, 7 Drawing Sheets

Prior Art

METHOD OF MANUFACTURING PLURAL PLASMA DISPLAY PANELS INCORPORATING THROUGH PORTS AT PERIPHERAL CORNERS OF EACH MANUFACTURED DISPLAY

RELATED APPLICATIONS

This application is the U.S. National Phase under 35 U.S.C. § 371 of International Application No. PCT/JP2006/309580 filed on May 12, 2006, which in turn claims the benefit of Japanese Application No. 2005-142664 filed on May 16, 2005, and Japanese Application No. 2005-142665 filed on May 16, 2005, the disclosures of which Applications are incorporated by reference herein.

TECHNICAL FIELD

The present invention relates to a method of manufacturing a plasma display panel and, more specifically, to a method of deriving a plurality of glass substrates from a large-sized substrate glass.

BACKGROUND ART

For use as display devices capable of displaying high-quality television images on a large screen as being possible to make displays at higher speed than liquid crystal panels and to be reduced in size with ease, expectations are running high for display devices e.g., color television receivers, using plasma display panels (hereinafter, referred to as "PDPs") of displaying images by exciting, for light emission, luminous elements using ultra rays through noble gas discharge. The PDPs are receiving attention as large-screen display devices for high definition use. With attention given as such, the development is actively underway to realize an increase of the display quality, e.g., high definition and high luminance, an increase of the reliability, and a decrease of the cost.

The PDP includes a front plate and a rear plate each configured by a glass substrate or others, and the plates are disposed to face each other and hermetically sealed. The PDP forms therein a discharge space, and a discharge gas is filled in the discharge space. The PDP configured as such is provided with an exhaust pipe for, after the front plate and the rear plate are hermetically attached to each other, evacuating the discharge space and filling the space with a discharge gas. As an exemplary method of manufacturing a conventional PDP, Japanese Patent Unexamined Publication No. 2001-283741 describes an example or others of using, for a glass substrate of the rear plate, glass substrate 152 that is cut into a single-plate size and processed as shown in FIG. 7, and is formed with through port 151 at corner portion 150 for provision of the exhaust pipe. The method goes through an evacuation step and an attachment step at the same time.

In order to increase the production efficiency of the PDP and reduce the manufacturing cost thereof, a so-called multi-panel manufacturing technique is considered useful, with which a structure of a PDP is formed using a single large-sized substrate glass including a plurality of glass substrates each of a predetermined size, and then is cut into glass substrates each of a predetermined size.

For application of such a multi-panel manufacturing technique, the position of the through port for provision of the exhaust pipe plays an important role. The through port is required to be formed in advance to a large-sized substrate glass. Therefore, depending on where the through port is positioned in the large-sized substrate glass, the substrate glass may be cracked or damaged, thereby causing a problem of reducing the yield.

DISCLOSURE OF THE INVENTION

The present invention is directed to a method of manufacturing a PDP in which a discharge space is formed by a pair of glass substrates disposed to face each other, and a through port is formed at a corner portion of at least one of the glass substrates for filling a discharge gas to the discharge space. The method includes: a step of forming the through port of the glass substrate to a rim portion of a single piece of substrate glass that is to be cut into two or more of the glass substrate; and a step of forming a structure of the plasma display panel to the substrate glass.

Such a configuration implements the multi-plane manufacturing technique with high yield by easing processing of through ports using simply-structured processing jigs, and by preventing cracks and damages of substrate glasses.

DESCRIPTION OF REFERENCE NUMERALS

Figure 1:
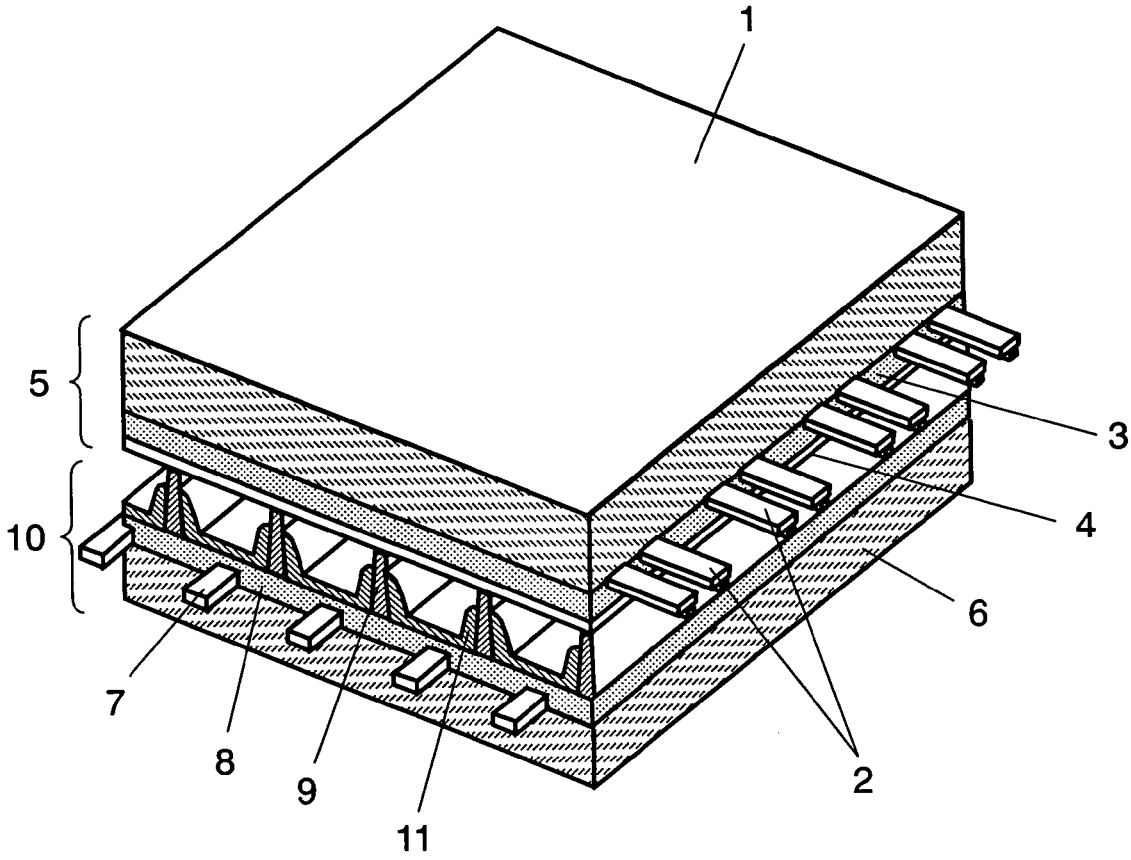
FIG. 1 is a perspective view showing the configuration of a PDP manufactured by a PDP manufacturing method in a first embodiment of the present invention.

1, 6, 43, 43*a*, 43*b*, 43*c*, 43*d*, 43*e*, 43*f*, 152 glass substrate
2 display electrode pair
3 dielectric layer
4 protection layer
5 front plate
7 data electrode
8 base dielectric layer
9 barrier rib
10 rear plate
11 phosphor layer
15 sealing member
16 exhaust pipe
21, 44*a*, 44*b*, 44*c*, 44*d*, 44*e*, 44*f*, 151 through port

30, 40, 70, 71 substrate glass
31, 32, 41, 42, 73, 74, 75, 76 cutting line
60, 61, 62 extraction terminal portion
150 corner portion

BEST MODE FOR CARRYING OUT THE INVENTION

In the below, embodiments of the present invention are described by referring to the accompanying drawings.

FIRST EMBODIMENT

Figure 2:
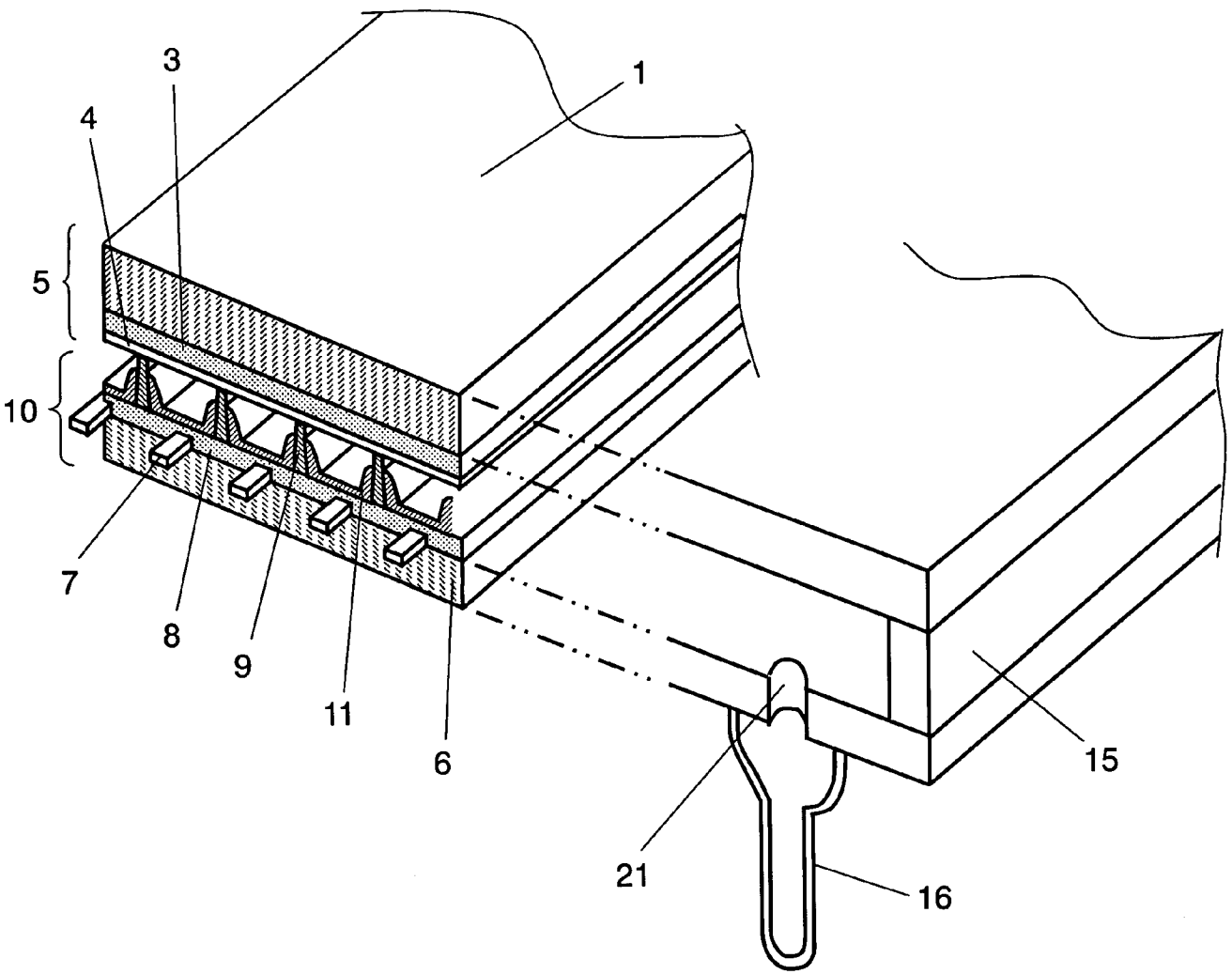
FIG. 2 is a perspective view showing the configurations of main components of the PDP in the first embodiment of the present invention.

FIG. 1 is a perspective view showing the configuration of a PDP manufactured by a PDP manufacturing method in a first embodiment of the present invention, and FIG. 2 is a perspective view showing the configurations of main components of the PDP in this embodiment.

As shown in FIG. 1, the PDP is configured by front plate 5 and rear plate 10. Front plate 5 is configured to include display electrode pairs 2 formed on one surface of glass substrate 1 in a striped manner, dielectric layer 3 covering display electrode pairs 2, and protection layer 4 formed on dielectric layer 3. Rear plate 10 is configured to include data electrodes 7 formed on one surface of glass substrate 6 in a striped manner, base dielectric layer 8 covering data electrodes 7, barrier ribs 9 disposed in a striped manner for segmenting a discharge space formed on base dielectric layer 8, and phosphor layer 11 coated to grooves each formed between the barrier ribs 9. Front plate 5 and rear plate 10 are so disposed that display electrode pairs 2 face data electrodes 7, and the discharge space formed by barrier ribs 9 is filled with a discharge gas (Ne—Xe gas or He—Xe gas). Display electrode pairs 2 intersect with data electrodes 7, and their intersection portions each serve as a discharge cell. That is, the discharge cells are arranged in a matrix, and the discharge cells having phosphor layer 11 of red, green, and blue serve as pixels for color display.

In a sustain discharge period, the PDP applies a pulse voltage between display electrode pairs 2 to cause discharge, and using ultraviolet rays generated by this discharge, excites a fluorescent element of phosphor layer 11 for conversion into visible light. This visible light passes through protection layer 4, dielectric layer 3, and others, so that images or videos are displayed.

As shown in FIG. 2, front plate 5 and rear plate 10 are sealed together by sealing member 15 (also referred to as frit glass) whose rim end portion is made of low-melting-point glass or others. Glass substrate 6 of rear plate 10 is formed with, at its corner portion, through port 21 with a linkage to the discharge space formed by barrier ribs 9, and through port 21 is connected with exhaust pipe 16 and then sealed. As such, the inside of the discharge space is evacuated in a vacuum by exhaust pipe 16, a discharge gas is filled through the exhaust pipe 16, and the exhaust pipe 16 is lastly chipped off.

Figure 7:
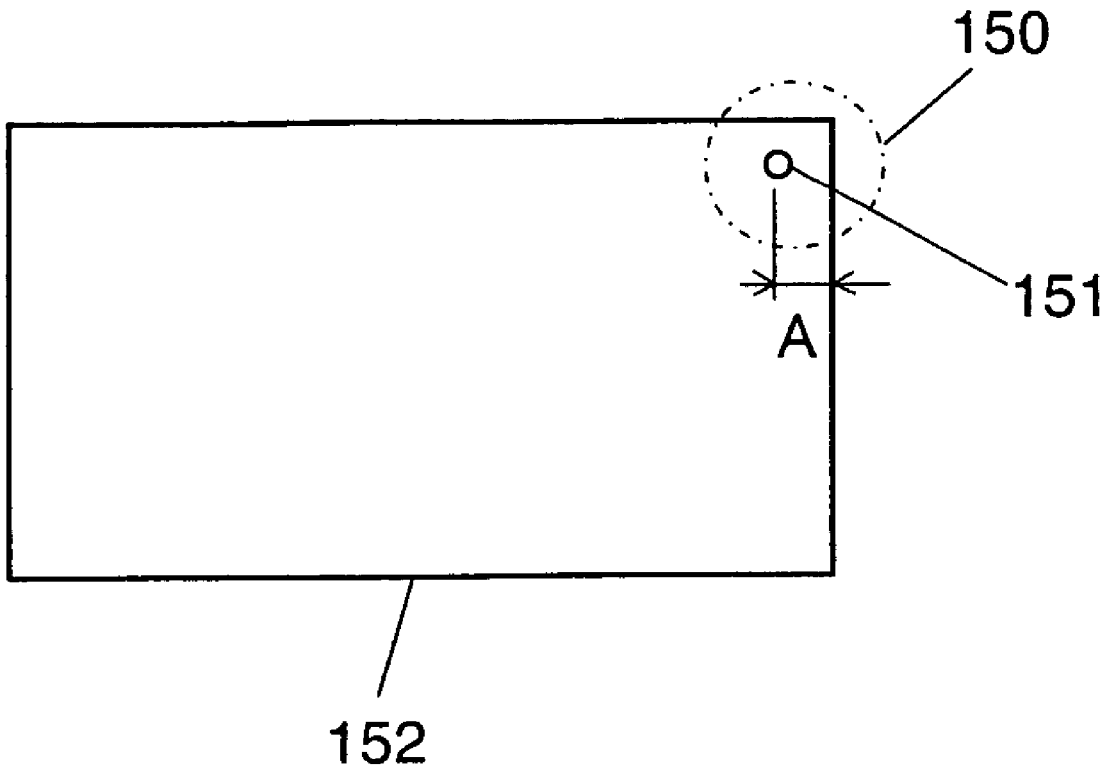
FIG. 7 is a plane view of a glass substrate of a conventional PDP.

Note here that glass substrate 6 configuring rear plate 10 for use in this embodiment is the same as glass substrate 152 described by referring to FIG. 7, and glass substrate 6 is formed with through port 21 at its corner portion. Glass substrate 6 is exemplified by a high-strain-point glass having the dimension of about 1000 mm×550 mm and the thickness of about 3 mm with a 42-inch diagonal PDP. Glass substrate 6 formed with through port 21 is formed with structures necessary for a PDP, e.g., electrodes, dielectric layer, barrier ribs, and phosphor layer. In this embodiment, rear plate 10 of a predetermined size is manufactured using a single piece of large-sized substrate glass that can be cut into a plurality of glass substrates 6 by the multi-plate manufacturing technique, in which the substrate glass is formed thereon with the PDP structures, and then the substrate glass is cut into a plurality of glass substrates of a predetermined size so that a plurality of rear plates can be derived.

Figure 3:
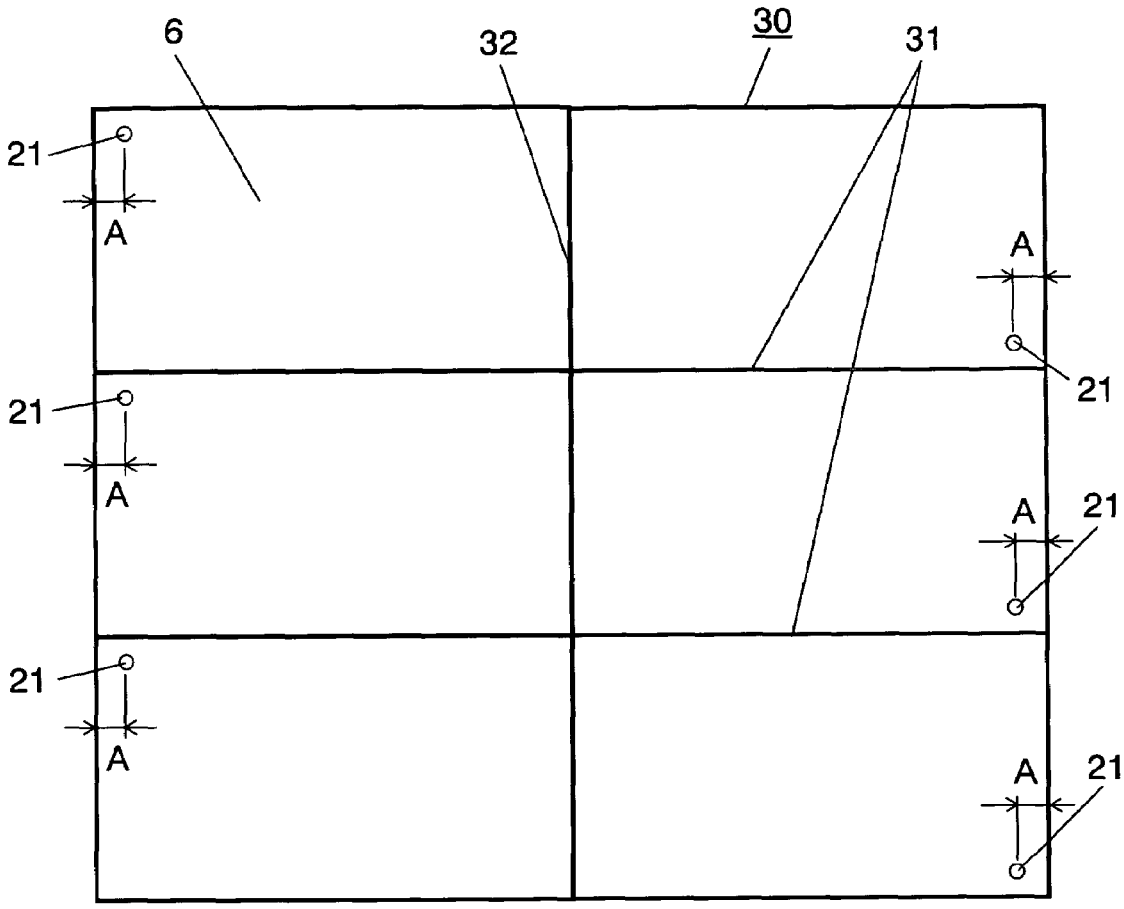
FIG. 3 is a plane view of a substrate glass showing the placement of glass substrates derived by a multi-plane manufacturing technique in the PDP manufacturing method in the first embodiment of the present invention.

FIG. 3 is a diagram showing the placement of glass substrates 6 derived by the multi-plane manufacturing technique in the PDP manufacturing method in the first embodiment. By cutting a single piece of substrate glass 30 along cutting lines 31 and 32, six pieces of glass substrate 6 can be derived, and three of the glass substrate 6 are disposed in the vertical (line) direction, and two thereof are disposed in the horizontal (column) direction. As shown in FIG. 3, through ports 21 formed to the glass substrates 6 at their corner portions are provided at the rim portion of substrate glass 30. Herein, substrate cutting is of a manufacturing step for the components configuring the PDP, and may be any step to be executed after printing, or after drying, burning, or others.

Figure 4:
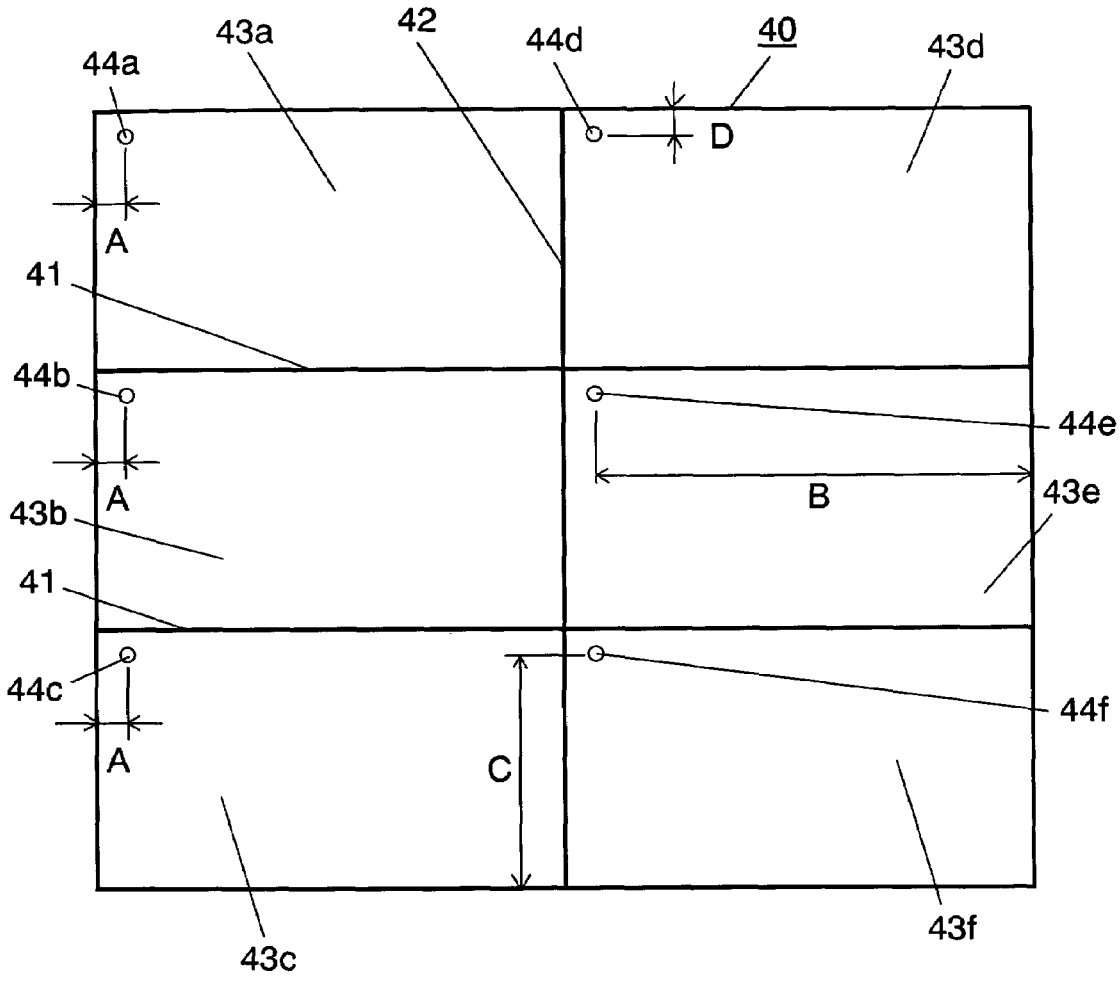
FIG. 4 is a plane view of a substrate glass showing another exemplary placement of glass substrates derived by the multi-plane manufacturing technique in the first embodiment of the present invention.

On the other hand, FIG. 4 is a diagram showing another exemplary placement of glass substrates 43 in the multi-plane manufacturing technique, and by cutting a single piece of substrate glass 40 along cutting lines 41 and 42, six pieces of glass substrate 43 can be derived. As shown in FIG. 4, as to glass substrates 43 as a result of substrate cutting, i.e., glass substrates 43*a*, 43*b*, 43*c*, 43*d*, 43*e*, and 43*f*, three are disposed in the vertical (line) direction, and two are disposed in the horizontal (column) direction. In FIG. 3, through ports 21 provided at the corner portions of glass substrates 6 are provided to the rim portion of substrate glass 40. Note here that, in FIG. 4, through ports 44*a*, 44*b*, 44*c*, and 44*d* provided to substrate glass 40 correspondingly to glass substrates 43*a*, 43*b*, 43*c*, and 43*d*, respectively, are provided to the rim portion of substrate glass 40, but through ports 44*e* and 44*f* corresponding to glass substrates 43*e* and 43*f* are located in an internal area of substrate glass 40. Accordingly, distances B and C from through ports 44*e* and 44*f* to an end surface of substrate glass 40 are both considerably larger than distances A and D from through ports 44*a*, 44*b*, 44*c*, and 44*d* to the end surface of substrate glass 40.

That is, for placement of glass substrates 43 as such, the distances B and C of through ports 44*e* and 44*f* will be longer than the distance A from the end portion of single-plate glass substrate 152 to through port 151 in FIG. 7. As a result, conventional tool equipment and jig may have a difficulty in hole-processing of the through ports, and this increases the manufacturing cost due to the need for investment of any new equipment. From a viewpoint of the manufacturing step, if the internal area of substrate glass 40 includes any to-be-processed portion, this easily cracks or damages the glass even with a slight deformation observed to the substrate glass 40. In a case of cutting the substrate glass into glass substrates 43 each of a predetermined size after the burning step, the through port located in the vicinity of the center portion of substrate glass 40 easily causes glass cracks with the influence of the thermal distortion by heating in the burning step.

On the other hand, with the placement of glass substrates 6 derived by the multi-plane manufacturing technique of FIG. 3 in the PDP manufacturing method in the embodiment, the distance A from the end portion of substrate glass 30 to the through port can be the same as the distance A from the end portion of conventional single-plate glass substrate 152 of FIG. 7 to the through port. This thus enables processing using any conventional tool equipment and jig, and even if the number of processes is increased to manufacture the through ports, this enables jig sharing and standardization, device simplification and no-complication, and others. Moreover, because the processing portions are separately positioned around substrate glass 30, glass cracks hardly occur in the circumferential portion observed with no glass deformation. Moreover, even with the manufacturing method in which the components of the PDP are subjected to the burning step on the substrate glass 30, glass cracks hardly occur with no influences of thermal distortion by heating, for example.

In the present embodiment shown in FIG. 3, glass substrates 6 are arranged in two columns on substrate glass 30. This configuration allows to provide every through port 21 to the rim portion of substrate glass 30 so that the effects similar to the above can be derived.

Also in the configuration of the present embodiment shown in FIG. 3, glass substrates 6 are arranged in two columns on substrate glass 30, and through ports 21 formed to glass substrates 6 arranged in the same line are disposed on a diagonal line. With such a configuration, after cutting, the glass substrates 6 can be similarly subjected to processing only by being rotated by 180 degrees so that the tact of the PDP manufacturing can be increased.

Note that exemplified in the above description is a case of deriving six pieces of glass substrate 6 from a single piece of substrate glass 30. Another configuration will lead to the similar effects that the number of glass substrates is even, and on the same side of glass substrates 6, two or more through ports are formed.

Described in the present embodiment is the case of forming the through ports to glass substrates 6 of rear plate 10, but other cases will also do, e.g., the case of forming a through port to glass substrate 1 of front plate 5, or the case of forming a through port to both of those.

SECOND EMBODIMENT

Figure 5:
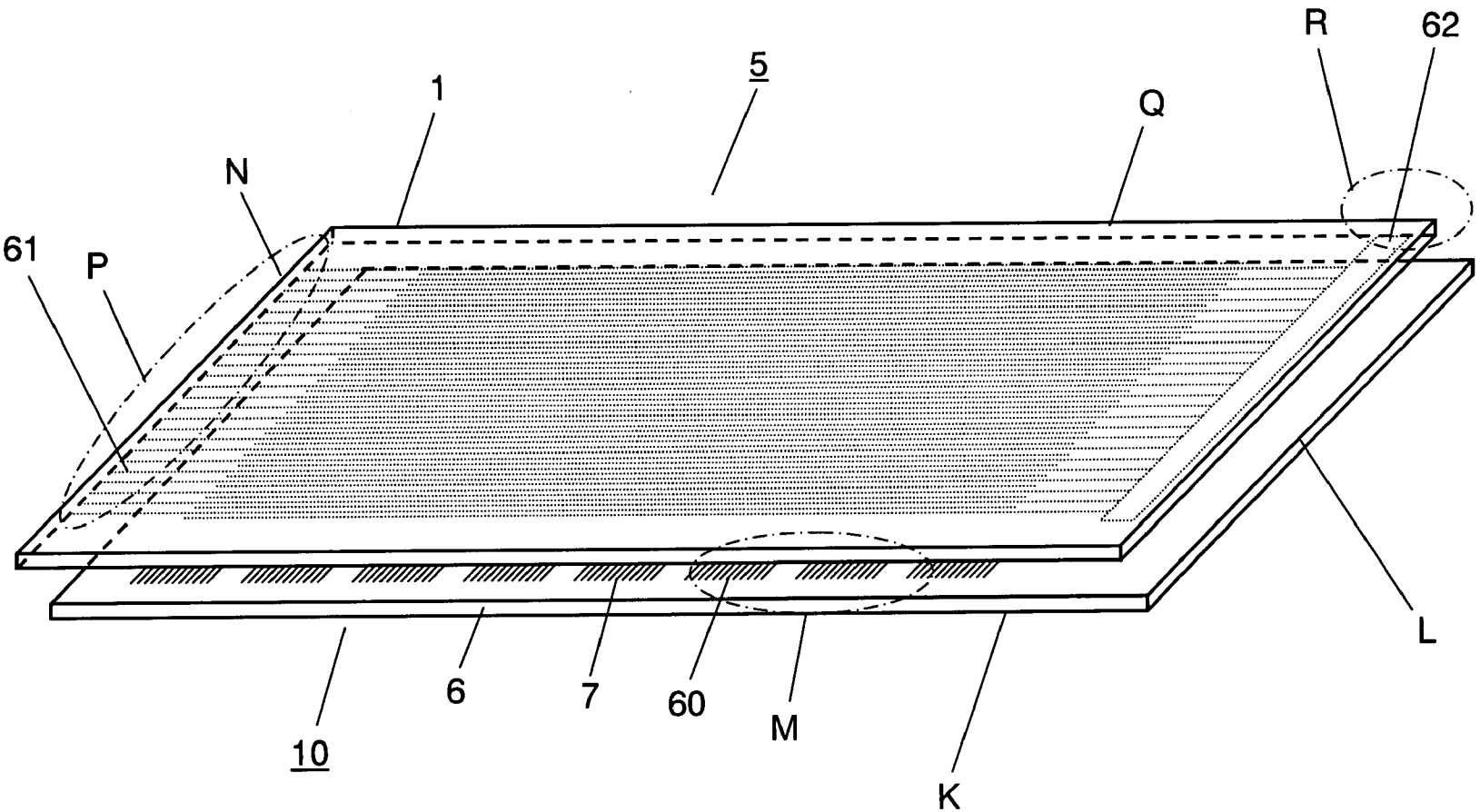
FIG. 5 is a perspective view showing the outer view of a PDP in a second embodiment of the present invention.

FIG. 5 is a perspective view showing the outer view of a PDP in a second embodiment of the present invention. FIG. 5 shows the state in which front plate 5 and rear plate 10 are attached together to derive a PDP. In the present embodiment, glass substrate 1 of front plate 5 and glass substrate 6 of rear plate 10 are both shaped rectangular with the same dimension. Two adjacent sides out of four sides of glass substrate 6 of rear plate 10, i.e., sides K and L, are located outside of glass substrate 1 of front plate 5, and their surfaces each formed with electrodes are so disposed as to face each other. That is, in the configuration, front plate 5 and rear plate 10 are disposed by moving either thereof in parallel along the diagonal line of the rectangular. Moreover, a sealing portion (not shown) is formed to the circumferential portion of the area in which glass substrate 1 of front plate 5 overlaid on glass substrate 6 of rear plate 10, and the attachment state is established thereby with a discharge space formed inside.

Moreover, as shown in FIG. 5, extraction terminal portion 60 of data electrodes 7 is formed to an end portion area M, which is facing the side K of rear plate 10 located outside of front plate 5, and in an end portion area P facing a side N of front plate 5 located outside of rear plate 10, an extraction terminal portion 61 is provided correspondingly to every scanning electrode configuring display electrode pairs (not shown). Moreover, in an end portion area facing a side Q of front plate 5 located outside of rear plate 10, an extraction terminal portion 62 is provided with a plurality of sustain electrodes configuring display electrode pairs short-circuited. That is, as shown in FIG. 5, it becomes able to form, with ease, extraction terminal portions 60, 61, and 62 extending from the respective electrodes to the end portions facing outside of front and rear plates 5 and 10.

Figure 6A:
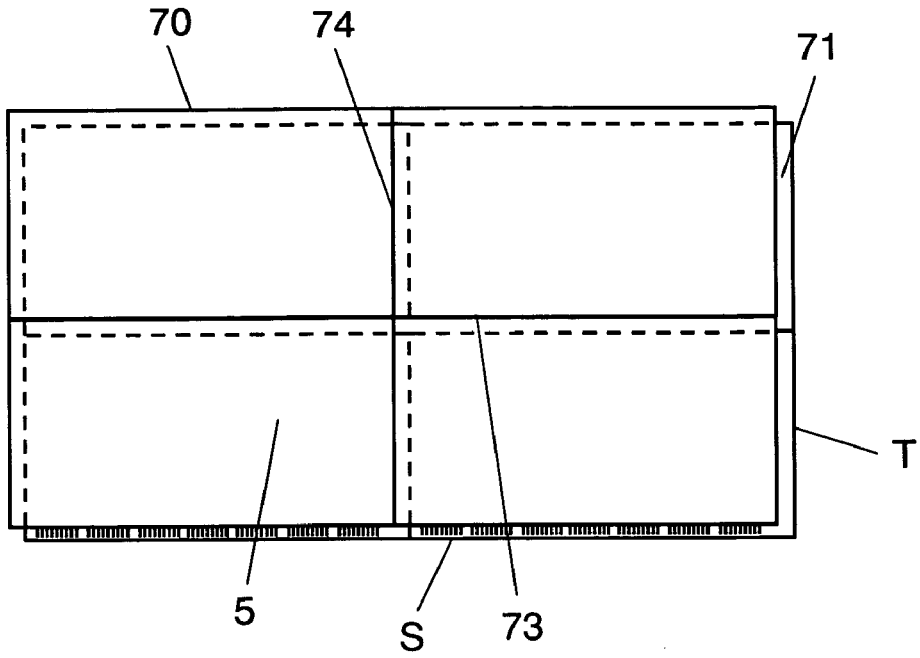
FIG. 6A is a plane view, viewed from the side of a substrate glass of a front plate, of an attachment structure of substrate glasses at the time of manufacturing, by the multi-plane manufacturing technique, the PDP in the second embodiment of the present invention.
Figure 6B:
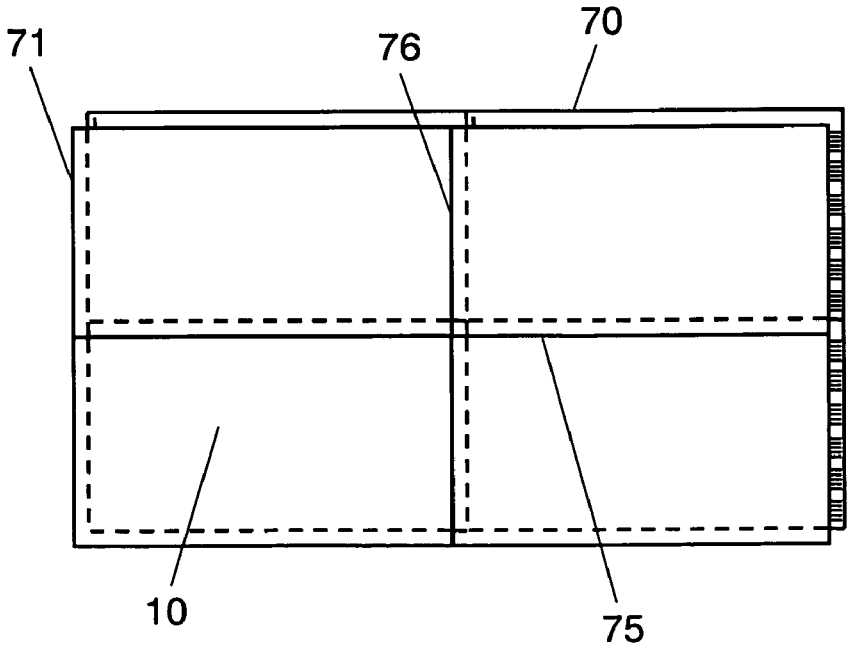
FIG. 6B is a plane view, viewed from the side of a substrate glass of a rear plate, of an attachment structure of substrate glasses at the time of manufacturing, by the multi-plane manufacturing technique, the PDP in the second embodiment of the present invention.

Described next is a method of manufacturing the PDP of the present embodiment with the multi-plane manufacturing technique. FIGS. 6A and 6B are each aplane view of an attachment structure of substrate glasses 70 and 71 when the PDP in the present embodiment of the present invention is manufactured by the multi-plane manufacturing technique. As shown in FIGS. 6A and 6B, with this manufacturing method, from a single piece of substrate glass 70 and a single piece of substrate glass 71, a plurality of substrates can be derived, i.e., four of glass substrate 1 of front plate 5 (shown in FIG. 5) and four of glass substrate 6 of rear plate 10 (shown in FIG. 5) can be derived. Because glass substrate 1 and glass substrate 6 are both shaped rectangular with the same dimension, substrate glass 70 and substrate glass 71 will have the same dimension.

FIGS. 6A and 6B each show the state in which a piece of substrate glass 70 and a piece of substrate glass 71 are formed with components such as electrodes for four pieces of front plate 5 and those of rear plate 10, and substrate glasses 70 and 71 are attached together after being disposed to face each other. Accordingly, front plate 5 and rear plate 10 are attached together by a sealing portion in a predetermined area.

FIG. 6A is a plane view of front plate 5 viewed from the side of substrate glass 70, and FIG. 6B is a plane view of rear plate 10 viewed from the side of substrate glass 1. As shown in FIG. 6A, substrate glasses 70 and 71 are so disposed as to face each other with sides S and L of substrate 71 being located outside of substrate glass 70.

Accordingly, by forming cutting lines 73 and 74 to substrate glass 70 that is formed with four PDPs and completed with sealing, and by cutting substrate glass 71 along formed cutting lines 75 and 76, 4 PDPs can be manufactured at the same time.

As such, according to the present embodiment, as to the PDP, a substrate glass is cut after sealing is completed so that no dust or foreign substance enters the discharge space or the structures of the PDP, thereby enabling to reduce a problem of poor illumination. What is more, a transfer step can be simplified so that the productivity can be increased, and the cost can be reduced.

With the PDP in this embodiment, the same type of glass substrate can be used for both glass substrates 1 and 6 of front and rear plates 5 and 10, and by arbitrarily adjusting their attachment position, any predetermined display area can be derived, and the resulting PDP can be provided with better productivity.

Note that, in the present embodiment, the PDP is manufactured by cutting substrate glasses 70 and 71 after sealing is completed. Alternatively, substrate glasses 70 and 71 may be firstly cut, and then front plate 5 may be attached to rear plate 10 piece by piece in any predetermined area by a sealing portion. This also enables to use the same type of glass substrate for glass substrate 1 of front plate 5 and glass substrate 6 of rear plate 10, and through arbitrary adjustment of their attachment position, any predetermined display area can be derived.

INDUSTRIAL APPLICABILITY

With a PDP manufacturing method of the present invention, by forming through ports to a rim portion of substrate glass from which a plurality of substrates are to be derived, the through ports can be subjected to hole-processing with more ease, and glass cracks can be prevented. This method enables to derive a substrate glass with low cost because two or more substrates can be easily derived therefrom, and the cost can be reduced thereby.

The invention claimed is:

1. A method of manufacturing a plasma display panel in which a discharge space is formed by a pair of glass substrates disposed to face each other, and a through port is formed at a corner portion of at least one of the glass substrates for filling a discharge gas to the discharge space, the method comprising:

a step of providing a substrate glass from which a plurality of glass substrates are to be cut out, wherein the glass substrates to be cut out are arranged in two columns and in at least two rows;

a step of forming all of the through ports, each of which being formed for each of the plurality of glass substrates to be cut out, at a rim portion of the substrate glass, wherein the through ports are formed on a diagonal row of a rectangular portion consisting of the glass substrate arranged in the same line out of the glass substrates arranged in two columns, and one of the through ports is disposed at a rim portion of the rectangular portion at one end portion of the diagonal line and other one of the through ports is disposed at the rim portion of the rectangular portion at an other end portion of the diagonal line; and a step of forming a structure of the plasma display panel to the substrate glass.

2. The plasma display panel manufacturing method of claim 1, wherein at least four glass substrates are to be cut out from the substrate glass.

* * * * *